US011548685B2

(12) United States Patent
Reinhart et al.

(10) Patent No.: US 11,548,685 B2
(45) Date of Patent: Jan. 10, 2023

(54) STACKABLE TOTE AND LID COMBINATION

(71) Applicant: Creative Plastic Concepts, LLC, Sycamore, OH (US)

(72) Inventors: Nickolas Reinhart, Findlay, OH (US); Jacob H. Whitta, Findlay, OH (US)

(73) Assignee: CREATIVE PLASTIC CONCEPTS, LLC, Sycamore, OH (US)

( * ) Notice: Subject to any disclaimer, the term of this patent is extended or adjusted under 35 U.S.C. 154(b) by 117 days.

(21) Appl. No.: 17/084,831

(22) Filed: Oct. 30, 2020

(65) Prior Publication Data

US 2021/0047075 A1 Feb. 18, 2021

Related U.S. Application Data

(63) Continuation of application No. 16/144,353, filed on Sep. 27, 2018, now Pat. No. 10,899,499.
(Continued)

(51) Int. Cl.
*B65D 43/02* (2006.01)
*B65D 45/20* (2006.01)
(Continued)

(52) U.S. Cl.
CPC ..... *B65D 21/0223* (2013.01); *B65D 21/0215* (2013.01); *B65D 21/0219* (2013.01); *B65D 21/04* (2013.01); *B65D 43/0204* (2013.01); *B65D 45/20* (2013.01); *B65D 2251/02* (2013.01); *B65D 2543/00027* (2013.01); *B65D 2543/00212* (2013.01)

(58) Field of Classification Search
CPC ..... B65D 21/0202; B65D 21/0219; B65D 21/0223; B65D 21/0215; B65D 21/0216; B65D 43/06; B65D 43/065; B65D 43/26; B65D 45/22; B65D 2543/00212; B65D 2543/00601; B65D 2555/02; B65D 21/0233
USPC ..... 206/512, 509, 511; 220/782, 519
See application file for complete search history.

(56) References Cited

U.S. PATENT DOCUMENTS 645,049 A * 3/1900 Bettendorf ..... E05B 65/5238 70/124
3,311,257 A 3/1967 Puente
(Continued)

FOREIGN PATENT DOCUMENTS

DE 1308861 A1 9/1994

*Primary Examiner* — Mollie Impink
(74) *Attorney, Agent, or Firm* — Jacob M. Ward; Ward Law Office LLC

(57) ABSTRACT

A stackable tote and lid combination has a lid with a main body and a rim. The rim has a wall with corner bodies, where the wall is spaced apart from a major surface. Each corner body has an upper surface with three outer side surfaces. Each first outer side surface is attached to a respective second outer side surface and each second outer side surface is attached to a respective third outer side surface. Each first, second, and third outer side surface is positioned between and connected to the upper surface of the respective corner body and the major surface of the main body. As a result, each first, second, and third outer side surface of respective corner bodies is configured to abut a hollow body of the stackable tote at three respective internal contact areas, and to removably hold the stackable tote.

20 Claims, 7 Drawing Sheets

Related U.S. Application Data

(60) Provisional application No. 62/563,713, filed on Sep. 27, 2017.

(51) Int. Cl.
*B65D 21/04* (2006.01)
*B65D 21/02* (2006.01)

(56) References Cited

U.S. PATENT DOCUMENTS 3,331,529 A 7/1967 Slapnik
3,447,714 A 6/1969 Elliot
3,586,205 A * 6/1971 Van Daalen ..... B65D 21/06 206/508
4,483,450 A 11/1984 Sanchez
5,105,947 A 4/1992 Wise
D648,538 S 11/2011 Reinhart et al.
D743,171 S 11/2015 Reinhart
D744,239 S 12/2015 Reinhart
D744,240 S 12/2015 Reinhart
D756,652 S 5/2016 Reinhart
D765,397 S 9/2016 Reinhart
D765,407 S 9/2016 Reinahrt
D765,409 S 9/2016 Reinhart
D765,410 S 9/2016 Reinhart
D765,411 S 9/2016 Reinhart
D766,577 S 9/2016 Reinhart
D768,385 S 10/2016 Reinhart
D773,821 S 12/2016 Reinhart
D776,932 S 1/2017 Reinhart
D792,105 S 7/2017 Reinhart
D794,958 S 8/2017 Reinhart
D816,492 S 5/2018 Reinhart
D834,315 S 11/2018 Reinhart
2006/0201943 A1* 9/2006 Uffner ..... B62B 3/16 280/33.998
2012/0012493 A1 1/2012 Cleveland et al.
2016/0023816 A1* 1/2016 Giraud ..... B65D 43/26 53/485
2017/0107015 A1 4/2017 Reinhart
2018/0237185 A1* 8/2018 Han ..... B65D 21/0216
2018/0339820 A1 11/2018 Reinhart et al.

* cited by examiner

STACKABLE TOTE AND LID COMBINATION

CROSS-REFERENCE TO RELATED APPLICATIONS

This application is a continuation of U.S. patent application Ser. No. 16/144,353, filed on Sep. 27, 2018, which in turn claims the benefit of U.S. Provisional Application No. 62/563,713, filed on Sep. 27, 2017. The entire disclosures of the above applications are incorporated by reference.

FIELD

The present disclosure relates generally to the field of storage totes and, more specifically, to a stackable storage tote and lid combination.

BACKGROUND

In recent years, consumers have become more and more concerned with the aesthetic appearance and functionality of garages, basements, closets, sheds, and other areas in which items tend to accumulate. As a result, consumers have invested vast sums of money on storage totes to store and organize accumulated items. Unfortunately, traditional storage totes are limited in their ability to provide an aesthetically appealing storage and organizational option which is both sturdy and stackable.

Known stackable totes are described in, for example, U.S. Pat. No. 3,447,714 to Elliot, which is directed to a non-circular, stackable lid and container combination that enables a user to open the lid. Similarly, U.S. Pat. No. 3,311,257 to Puente discloses a tote that can be stacked with other totes of similar construction to permit stacks to be made several totes high.

Nonetheless, there is a continuing need for a storage tote and lid combination that is lightweight, stackable, and better resistant to toppling when stacked several totes high. Desirably, the storage tote and lid combination facilitate both a latching and a stacking of the storage totes in operation.

SUMMARY

In concordance with the instant disclosure, a storage tote and lid combination that is lightweight, stackable, and resistant to toppling when stacked several totes high, and which facilitates both a latching and a stacking of the storage totes in operation, has been surprisingly discovered.

In a first embodiment, a lid for a stackable tote has a main body with a major surface and a raised rim. The raised rim has an upper wall and at least one corner body. The upper wall is spaced apart from the major surface. The corner body has an upper surface, a first outer side surface, a second outer side surface, and a third outer side surface. The first outer side surface intersects the second outer side surface. The second outer side surface intersects the third outer side surface. Each of the first, second, and third outer side surfaces are interposed between and connected to the upper surface of the corner body and the major surface of the main body. The first outer side surface, the second outer side surface, and the third outer side surface of the corner body are configured to abut a hollow body of a stackable tote at three areas of contact to removably hold the stackable tote.

In a second embodiment, the lid corner body further includes a fourth outer side surface that intersects the third outer side surface. The fourth outer side surface is interposed between and connected to the upper surface of the corner body and the major surface of the main body.

In a third embodiment, the rim has an inner wall interposed between and connected to the upper wall of the rim and the major surface of the main body. The rim inner wall and a rim outer wall depend from the rim upper wall and have a free edge. The corner body is interposed between a first section of the inner wall and a second section of the inner wall.

In a fourth embodiment, the corner body has a lower surface disposed opposite the upper surface and has at least one support pylon disposed thereon. The corner body is attached to at least one inner side surface of the corner body that has a lower surface. The support pylon is configured to enhance a rigidity of the corner body.

In a fifth embodiment, the support pylon has a height (H) that is less than a depth (D) of the major surface of the main body relative to the upper wall of the raised rim.

In a sixth embodiment, the inner side surface includes a first inner side surface, a second inner side surface, and a third inner side surface. The first inner side surface is disposed opposite the first outer side surface. The second inner side surface is disposed opposite the second outer side surface. The third inner side surface is disposed opposite the third outer side surface. The at least one pylon includes a first support pylon, a pair of second support pylons, and a third support pylon.

In a seventh embodiment, the first support pylon is attached to the first inner side surface with a first connecting rib. Each of the second support pylons is attached to the second inner side surface with a second connecting rib. The third support pylon is attached to the third inner side surface with a third connecting rib.

In an eighth embodiment, the first support pylon has a first support vane connecting the first support pylon to the lower surface. The first support vane is disposed opposite the first connecting rib. Each of the second support pylons has a second support vane connecting one of the second support pylons to the lower surface. The second support vane is disposed opposite the second connecting rib. The third support pylon has a third support vane connecting the third support pylon to the lower surface. The third support vane is disposed opposite the third connecting rib.

In a ninth embodiment, a thickness of the corner body is defined by a distance between one of a) the first outer side surface and the first inner side surface, b) the second outer side surface and the second inner side surface, and c) the third outer side surface. The third inner side surface is between about 0.050 inches and 0.100 inches in thickness.

In a tenth embodiment, the main body is formed from one of polypropylene and polyethylene.

In an eleventh embodiment, the major surface of the main body is disposed on a main plane. The first outer side surface is disposed on a first plane. The second outer side surface is disposed on a second plane. The third outer side surface is disposed on a third plane. Each of the first plane, the second plane, and the third plane intersect the main plane at an obtuse angle.

In a twelfth embodiment, the obtuse angle is about 95 degrees relative to the major plane on which the major surface of the main body is disposed.

In a thirteenth embodiment, the main body has a generally quadrilateral shape with four corners. The one corner body includes four corner bodies. Each of the four corner bodies is disposed adjacent one of four corners of the main body.

In a fourteenth embodiment, a stackable tote has a hollow body with a base wall, a first sidewall, a second sidewall, and a corner section. Each of the first sidewall, the second sidewall, and the corner section is connected to the base wall. The one corner section is interposed between and connected to the first and the second sidewalls. The one corner section includes a first exterior surface, a second exterior surface, and a third exterior surface. The first exterior surface, the second exterior surface, and the third exterior surface, of a corner section, are configured to abut a corner body of a lid for the stackable tote at three areas of contact to removably hold the stackable tote to the lid.

In a fifteenth embodiment, the stackable tote has an upper flange connected to each of the first sidewall, the second sidewall, and the corner section.

In a sixteenth embodiment, the stackable tote has at least one latch rotatably attached to the upper flange and configured to securely hold the lid on the upper flange of the hollow body.

In a seventeenth embodiment, the upper flange has at least one flange support depending therefrom. The at least one flange support is configured to abut another upper flange of another stackable tote in a stacked arrangement.

In an eighteenth embodiment, a length (L) of the at least one flange support is sufficient to provide a clearance between adjacent latches of the stackable tote and another stackable tote, which are in the stacked arrangement.

In a nineteenth embodiment, the stackable tote has at least one beveled wall interposed between and connected to the corner section and the base wall. The at least one beveled wall is configured to facilitate an insertion of the base wall of the stackable tote into the lid.

In a twentieth embodiment, a stackable tote includes a hollow body having a base wall, a first sidewall, a second sidewall, and a corner section. Each of the first sidewall, the second sidewall, and the corner section are connected to the base wall. At least one corner section is interposed between and connected to the first sidewall and the second sidewall. The at least one corner section includes a first exterior surface, a second exterior surface, and a third exterior surface.

DRAWINGS

The above, as well as other advantages of the present disclosure, will become clear to those skilled in the art from the following detailed description, particularly when considered in the light of the drawings described hereafter.

DETAILED DESCRIPTION

The following detailed description and appended drawings describe and illustrate various embodiments of the invention. The description and drawings serve to enable one skilled in the art to make and use the invention and are not intended to limit the scope of the invention in any manner.

Figure 1:
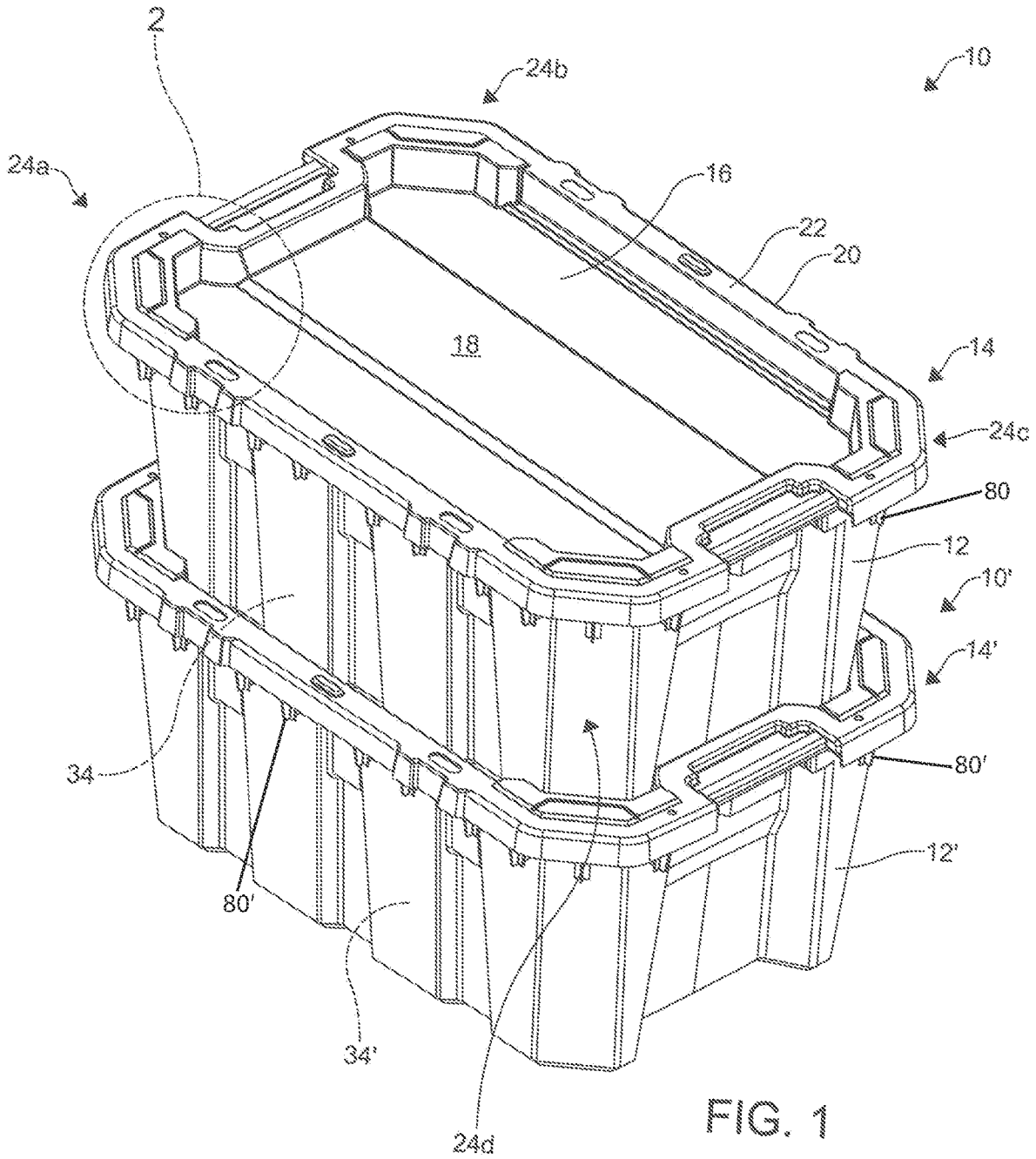
FIG. 1 is a top perspective view of an upper tote with an attached upper lid stacked on a lower tote with an attached lower lid, according to one embodiment of the present disclosure.

FIG. 1 illustrates an upper combination 10 of an upper stackable tote 12 with upper lid 14 that is stacked on top of a lower combination 10' of a lower stackable tote 12' with lower lid 14'. It is to be appreciated that the upper and lower combinations 10, 10' of the present disclosure are identical. Although the following description is primarily provided with respect to the upper combination 10, including the stackable tote 12 and the lid 14, it should be appreciated that the description equally applies to the lower combination 10', including the stackable tote 12' and the lid 14'.

Figure 2:
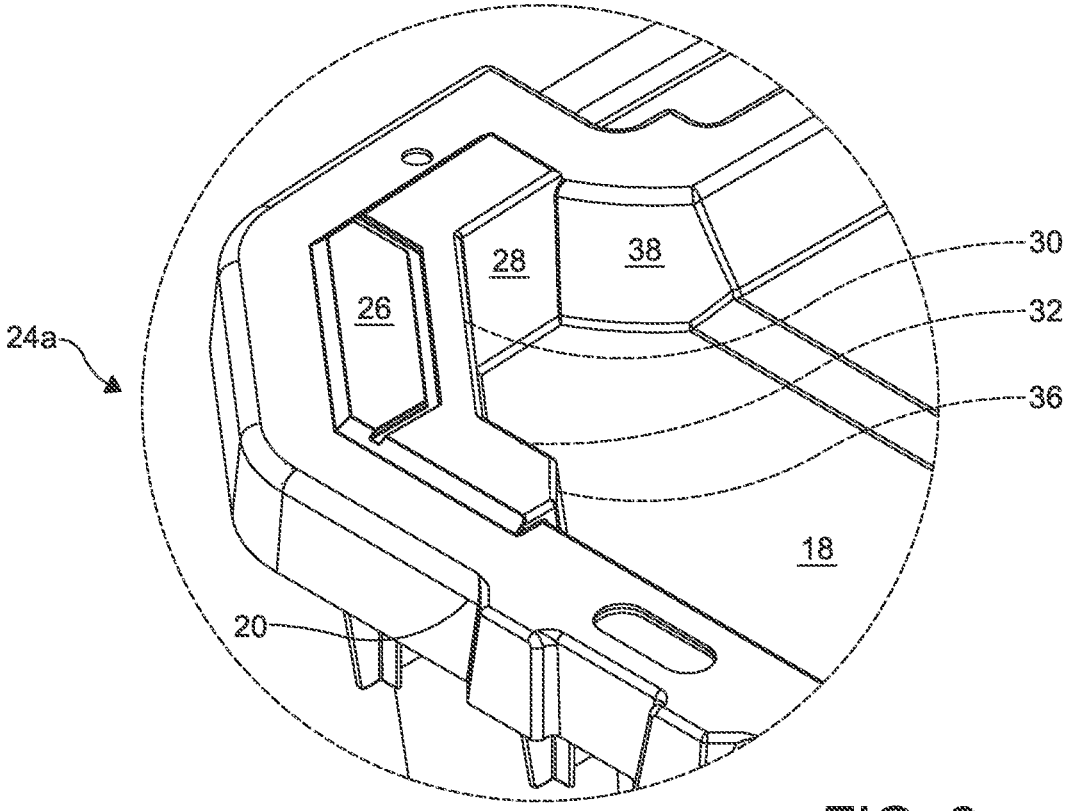
FIG. 2 is a first enlarged fragmentary top perspective view taken at call-out 2 of a left rear corner body of the upper lid of FIG. 1.

In a first embodiment, the lid 14 has a main body 16 having a major surface 18 and a raised rim 20. The raised rim 20 has an upper wall 22 and at least one corner body 24*a*, 24*b*, 24*c*, 24*d*, where the upper wall 22 is spaced apart from the major surface 18. FIG. 2 shows the left rear corner body 24*a* with an upper surface 26, a first outer side surface 28, a second outer side surface 30, and a third outer side surface 32 connected thereto. The first outer side surface 28 intersects the second outer side surface 30, the second outer side surface 30 intersects the third outer side surface 32, and each of the first, second, and third outer side surfaces 28, 30, 32 are interposed between and connected to the upper surface 26 of the corner body 24*a* and the major surface 18 of the main body 16.

Figure 3:
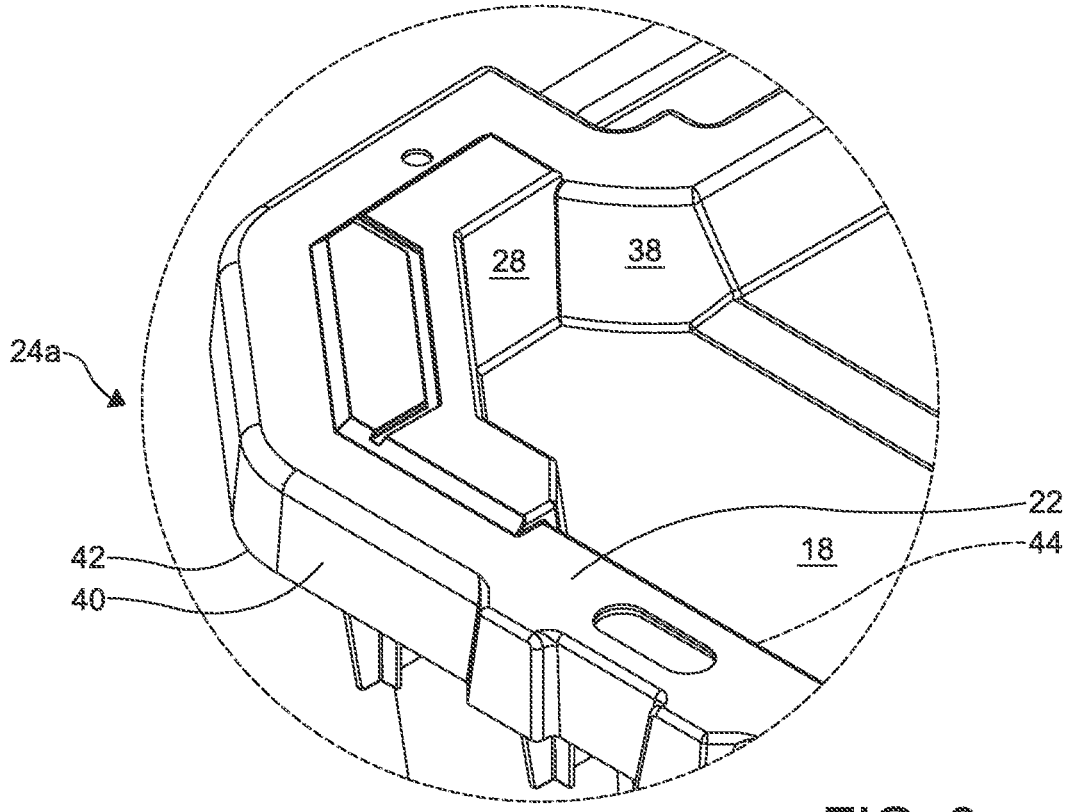
FIG. 3 is a second enlarged fragmentary top perspective view taken at call-out 2 of the left rear corner body of the upper lid of FIG. 1.
Figure 4:
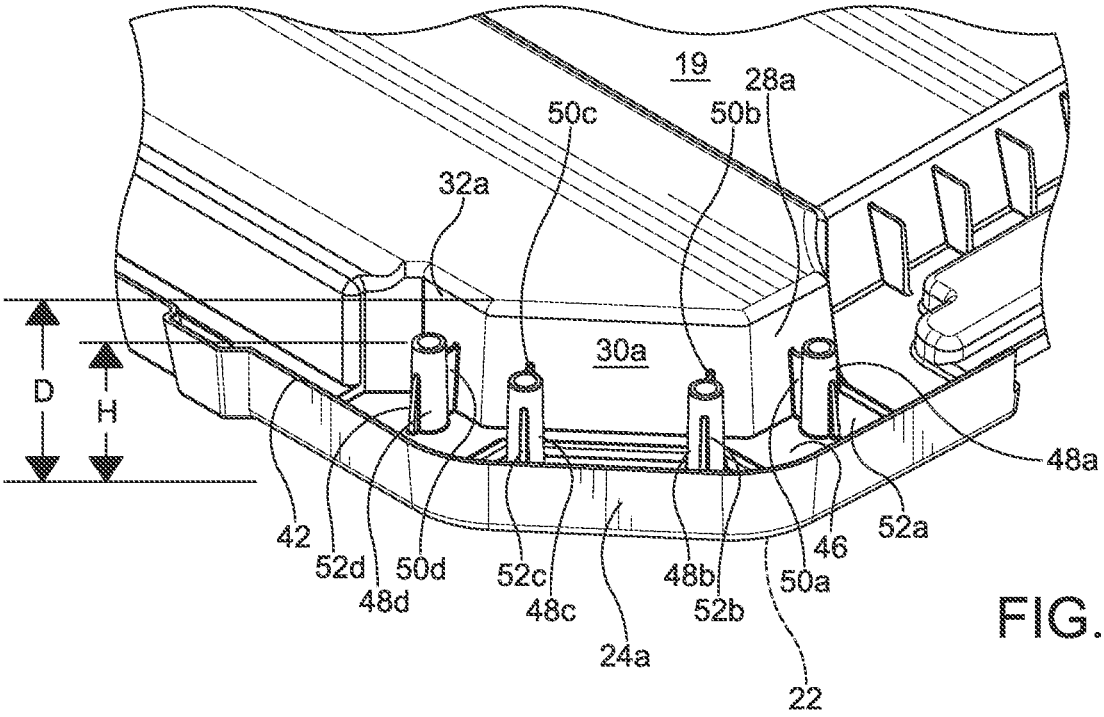
FIG. 4 is an enlarged fragmentary bottom perspective view taken at call-out 2 of an underbody of the corner body of the upper lid of FIG. 1.

Thereby, as shown in FIGS. 3 and 4, the first outer side surface 28, the second outer side surface 30, and the third outer side surface 32 of the corner body 24*a* are configured to abut a hollow body 34 of the stackable tote 12 at three respective internal contact areas 28*a*, 30*a*, 32*a* to removably hold the stackable tote 12. It has been found that this contacting at three distinct areas advantageously provides for a more stable connection between the upper and lower combinations 10, 10'.

In a second embodiment, as seen in FIG. 2, the lid corner body 24*a* further includes a fourth outer side surface 36 that intersects the third outer side surface 32. The fourth outer side surface 36 is interposed between and connected to the upper surface 26 of the corner body 24*a* and the major surface 18 of the main body 16.

In a third embodiment, the rim 20 has a first section of inner wall 38 interposed between and connected to the upper wall 22 of the rim 20 and the major surface 18 of the main body 16, as shown in FIGS. 2 and 3. The rim first section of inner wall 38 and an outer wall 40 depend from the upper wall 22 and have a free edge 42. The corner body 24*a* is interposed between a first section of the inner wall 38 and a second section of the inner wall 44.

As shown in FIG. 4, a fourth embodiment illustrates the corner body 24*a* having a lower surface 46 disposed opposite the corner body upper surface 26 that has at least one support pylon 48*a*, 48*b*, 48*c*, 48*d* disposed thereon, where the corner body 24*a* is attached to at least one inner side surface 28*a*, 30*a*, 32*a* of the corner body lower surface 46. The support pylons 48*a*, 48*b*, 48*c*, 48*d* are configured to enhance a rigidity of the corner body 24*a*. The support pylons 48*a*, 48*b*, 48*c*, 48*d* are shown as generally cylindrical in shape; however, one of ordinary skill in the art may also select other suitable shapes for the support pylons 48*a*, 48*b*, 48*c*, 48*d*, as desired.

Also shown in FIG. 4 is a fifth embodiment where each of the support pylons 48*a*, 48*b*, 48*c*, 48*d* has a height (H) that is less than a depth (D) of an underside surface 19 of the major surface 18, relative to the upper wall 22 of the raised rim 20. Advantageously, the height (H) of the support pylons 48*a*, 48*b*, 48*c*, 48*d* being less than the depth (D) results in a supporting of the underside of the at least one corner body 24*a*, 24*b*, 24*c*, 24*d* of the lid 14 by the tote 12 where the lid 14 is disposed on the tote 12. Also, the height (H) of the support pylons 48*a*, 48*b*, 48*c*, 48*d* being less than the depth (D) allows for the multiples ones of the lid 14 to be stacked on one another, for example, in a stowed configuration on a store shelf or floor where space is at a premium, or while being transported, while also sufficiently supporting the at least one corner body 24*a*, 24*b*, 24*c*, 24*d* and militating against an undesirable warping or bending of the lid 14 in storage or transport.

In a sixth embodiment, the first inner side surface 28*a* is disposed opposite the first outer side surface 28, the second inner side surface 30*a* is disposed opposite the second outer side surface 30, and the third inner side surface 32*a* is disposed opposite the third outer side surface 32. Respectively to the three outer side surfaces 28*a*, 30*a*, 32*a*, there are disposed the first support pylon 48*a*, the second and third support pylons 48*b*, 48*c*, and the fourth support pylon 48*d* (see FIG. 4).

In a seventh embodiment, the first support pylon 48*a* is attached to the first inner side surface 28*a* with a first connecting rib 50*a*. Each of the second and third support pylons 48*b*, 48*c* is attached to the second inner side surface 30*a* with respective second connecting rib 50*b*, 50*c*. The fourth support pylon 48*d* is attached to the third inner side surface 32*a* with a third connecting rib 50*d*. It should be appreciated that the ribs 50*a*, 50*b*, 50*c*, 50*d* stabilize and make more robust the various support pylons 48*a*, 48*b*, 48*c*, 48*d*, in operation.

In an eighth embodiment, also shown in FIG. 4, the first support pylon 48*a* has a first support vane 52*a* connecting the first support pylon 48*a* to the lower surface 46, where the first support vane 52*a* is disposed opposite the first connecting rib 50*a*. Each of the second and third support pylons 48*b*, 48*c* has respective second and third support vanes 52*b*, 52*c* respectively connecting the second and third support pylons 48*b*, 48*c* to the lower surface 46. Each of the second and third support vanes 52*b*, 52*c* is disposed opposite the second and third connecting ribs 50*b*, 50*c*. The fourth support pylon 48*d* has a fourth support vane 52*d* connecting the fourth support pylon 48*d* to the lower surface 46. The fourth support vane 52*d* is disposed opposite the fourth connecting rib 50*d*. As with the ribs 50*a*, 50*b*, 50*c*, 50*d*, in operation, it should be appreciated that the support vanes 52*a*, 52*b*, 52*c*, 52*d* stabilize and make more robust the various support pylons 48*a*, 48*b*, 48*c*, 48*d*.

In a ninth embodiment, as further shown in FIG. 4, a thickness of the corner body 24*a* is defined by a distance between one of a) the first outer side surface 28 and the first inner side surface 28*a, b*) the second outer side surface 30 and the second inner side surface 30*a*, and *c*) the third outer side surface 32 and the third inner side surface 32*a*. Each of these distances defining the thickness of the respective area of the corner body 24*a* may be between about 0.050 inches and 0.100 inches, for example. One of ordinary skill in the art may also select other suitable thicknesses, as desired.

In a tenth embodiment, the main body 16 of the lid 14 and also the tote 12 is formed from one of polypropylene and polyethylene. However, one of ordinary skill in the art may also select other suitable materials for the main body 16 within the scope of the present disclosure.

Figure 5:
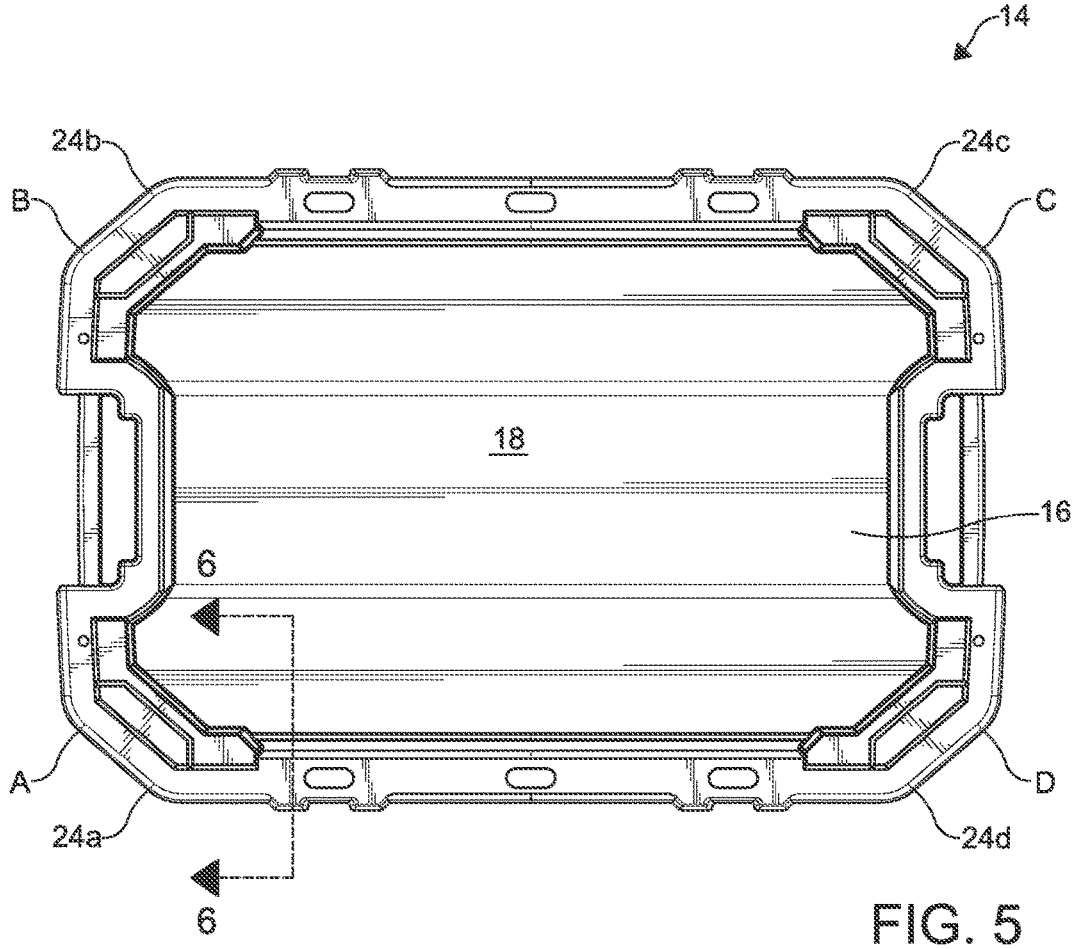
FIG. 5 is a top plan view of the upper lid of FIG. 1.
Figure 6:
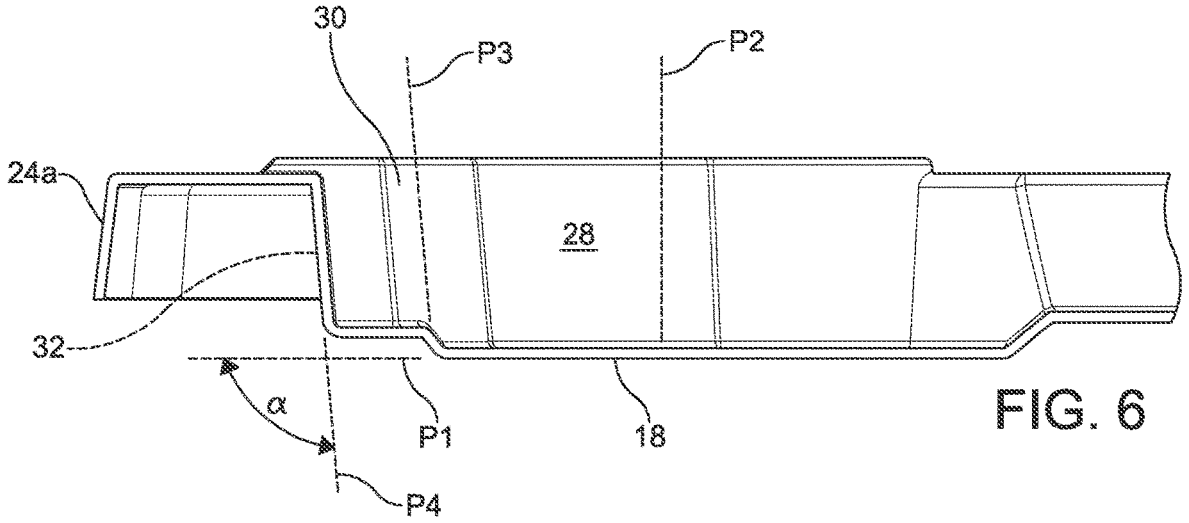
FIG. 6 is an enlarged section view of the left rear corner body of the upper lid taken at section line 6-6 in FIG. 5.

In an eleventh embodiment, as applied to the corner body 24*a*, FIGS. 5 and 6 illustrate that the major surface 18 of the main body 16 is disposed on a main plane P1. The outer side surface 32 is disposed on plane P4 that intersects the main plane P1 at an obtuse angle α. It is to be appreciated that the outer side surfaces 28, 30 are respectively disposed on planes P2, P3 that intersect the main plane P1 at the same obtuse angle α. Advantageously, the obtuse angle α facilitates a guiding and insertion of a base of the tote 12 into the lid 14', for example, as shown in FIG. 1.

In a twelfth embodiment, shown in FIG. 6, the obtuse angle α is greater than 90 degrees, more particularly between 90 degrees and 100 degrees, and most particularly about 95 degrees relative to the main plane P1 on which the major surface 18 of the main body 12 is disposed. However, a skilled artisan may select other suitable angles for the obtuse angle α within the scope of the present disclosure.

In a thirteenth embodiment and as illustrated in FIG. 5, the main body 16 has a generally quadrilateral shape with four corners A-D. Each of the respective four corner bodies 24*a*-24*d* is included in respective corners A-D and disposed adjacent thereof the main body 16. It should be appreciated that other general shapes having more or fewer corners may also be employed, as desired.

Figure 7:
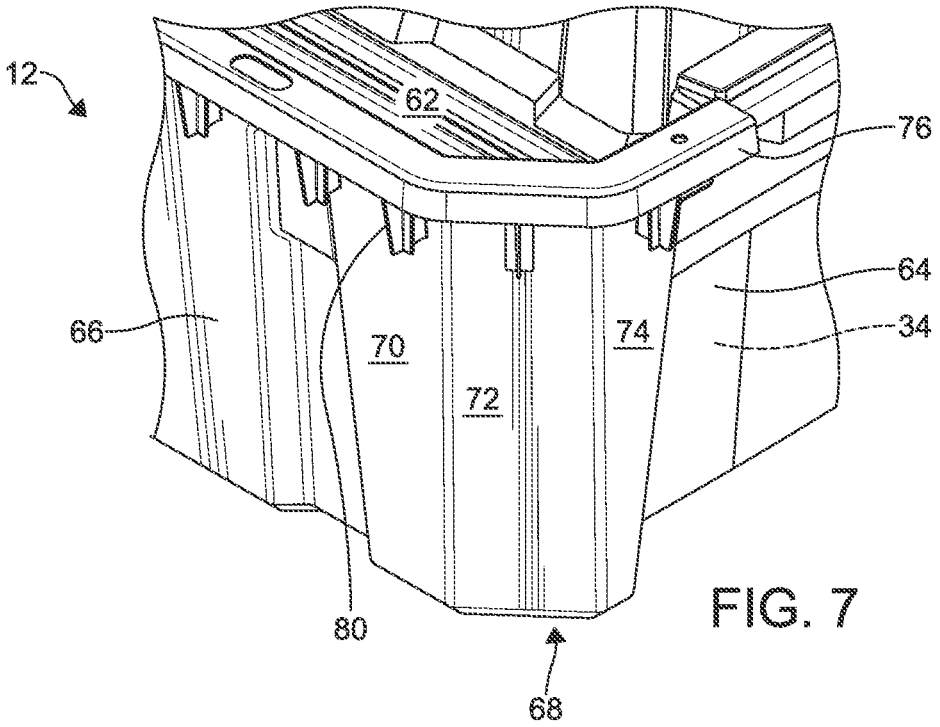
FIG. 7 is an enlarged top perspective fragmentary view of a left front corner body of the upper tote without the upper lid of FIG. 1 disposed thereon.

As shown in FIG. 7, a fourteenth embodiment includes the stackable tote 12 with the hollow body 34 having a base wall 62, a first tote sidewall 64, a second tote sidewall 66, and a tote corner section 68. Each of the first sidewall 64, the second sidewall 66, and the corner section 68 is connected to the base wall 62. The one corner section 68 is interposed between and connected to the first and the second sidewalls 64, 66, and the one corner section 68 includes a first tote corner exterior surface 70, a second tote corner exterior surface 72, and a third tote corner exterior surface 74. Thereby, the first exterior surface 70, the second exterior surface 72, and the third exterior surface 74, of the corner section 68, are configured to contact the corner body 24*d* of the lid 14 for the stackable tote 12, at the three areas 28*a*, 30*a*, 32*a* of contact to removably hold the upper stackable tote 12 in the lower lid 14'. It has been found that this contacting at three distinct areas advantageously provides for a more stable connection between the upper and lower combinations 10, 10'.

In a fifteenth embodiment, the stackable tote 12 has an upper flange 76 connected to each of the first sidewall 64, the second sidewall 66, and the corner section 68.

Figure 8:
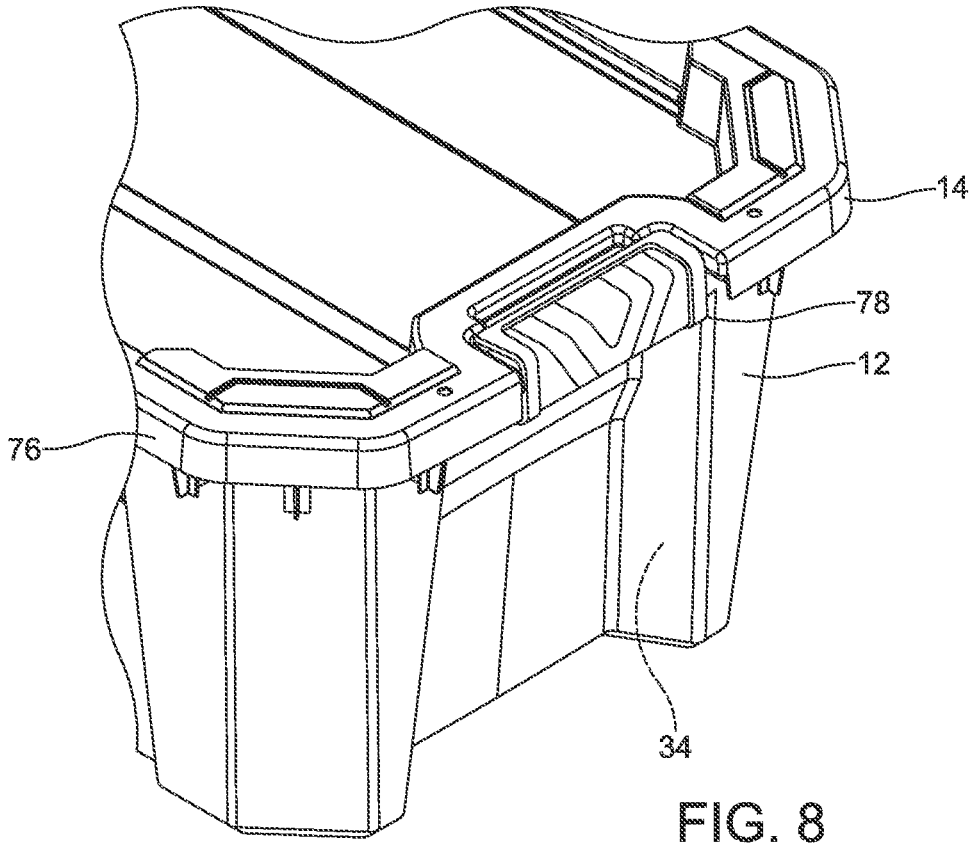
FIG. 8 is an enlarged fragmentary top perspective view of the front of the upper lid and upper tote of FIG. 1 with the upper lid connected to the upper tote by way of a latch.
Figure 9:
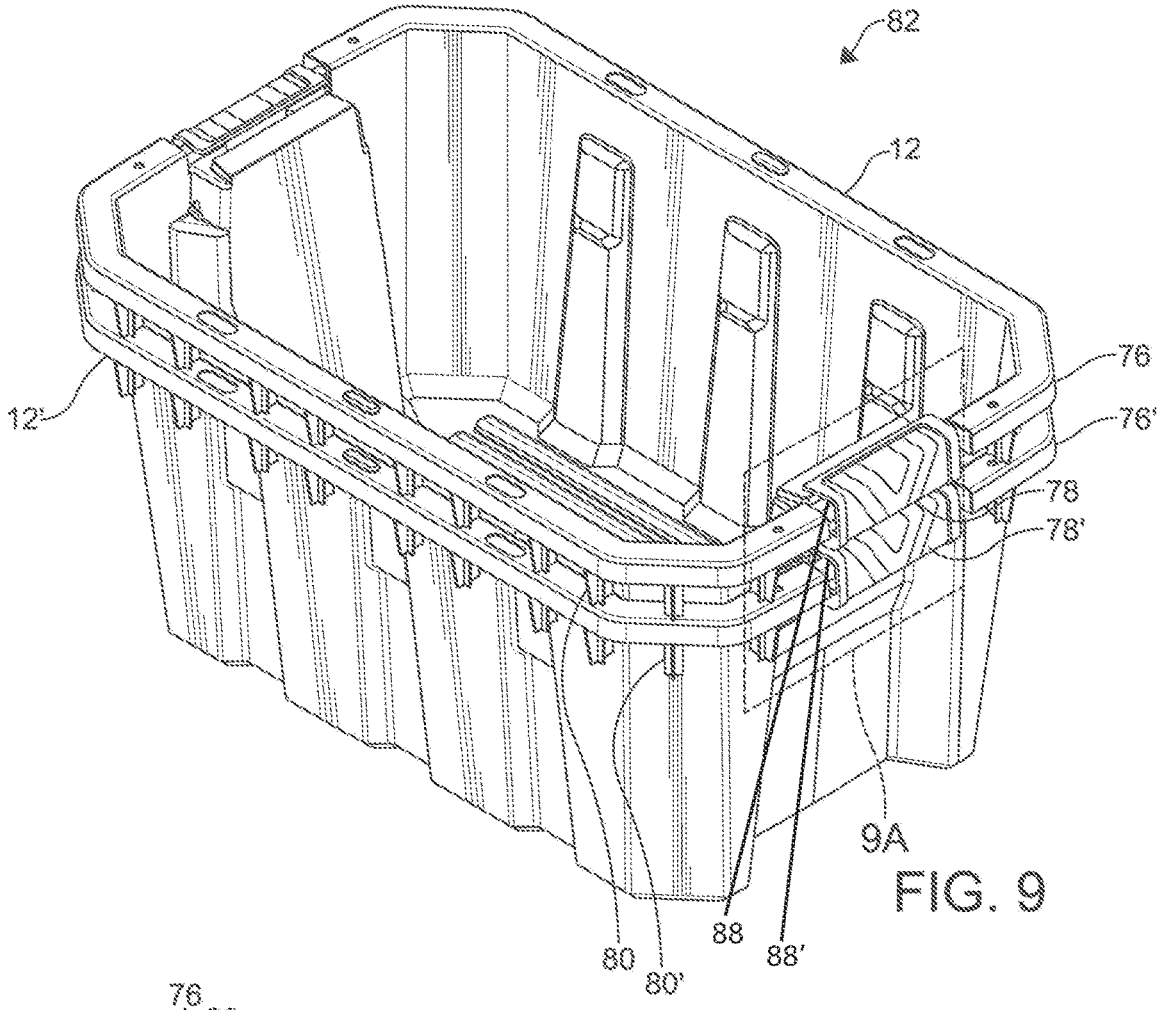
FIG. 9 is a top perspective view of the upper tote seated within the lower tote in a stowed arrangement, where both the upper and lower totes have latches disposed thereon.
Figure 9A:
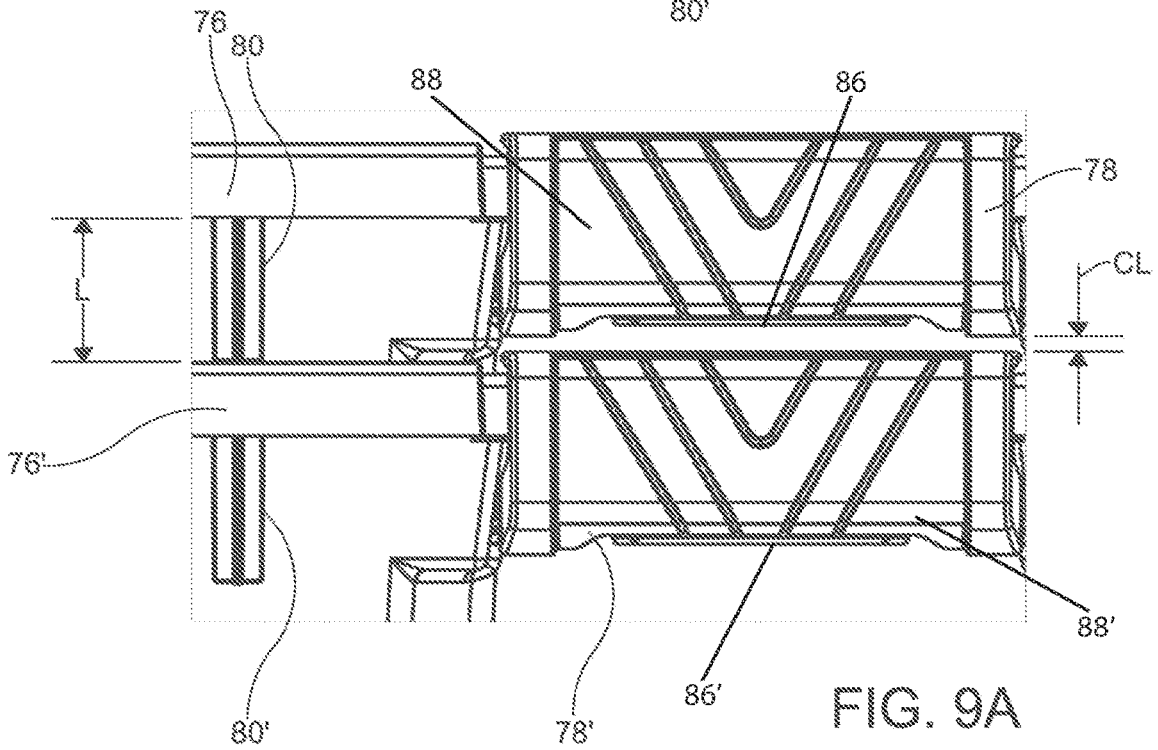
FIG. 9A is an enlarged front fragmentary view taken at call-out 9 of FIG. 9 and illustrating both upper and lower handles or latches.

In a sixteenth embodiment, and as illustrated in FIG. 8, the stackable tote 12 has at least one tote latch 78 rotatably attached to the tote upper flange 76. The at least one tote latch 78 is configured to securely hold the lid 14 on the upper flange 76 of the tote hollow body 34. For example, the at least one tote latch 78 may be selectively rotatable from a latched position (shown in FIGS. 8-9A) to an unlatched position (not shown), in operation. The at least one tote latch 78 has a bottom surface, a side surface, and a top surface. The top surface of the at least one latch is disposed at a height above the upper flange 76 of the hollow body 34. As shown in FIG. 9, the at least one tote latch 78 includes a channel 88, and the channel 88 includes a length. The channel 88 includes a protrusion 86 which extends downwardly toward the bottom surface of the at least one latch 78. Each of the channels 88, 88' may be configured to provide additional spacing between the latch 78 of the upper stackable tote 12 and the latch 78' of the lower stackable tote 12'. As illustrated in FIG. 9A, the at least one latch 78, 78', has an exterior surface marking configured to physically direct a user to the protrusion 86. As shown, the exterior surface marking includes a plurality of V-shaped markings.

In a seventeenth embodiment, and as illustrated in FIG. 1, 7, 9 and in call-out FIG. 9A, the tote upper flange 76 has at least one flange support 80 depending therefrom. In FIGS. 9 and 9A the at least one flange support 80 is configured to abut an upper flange 76' of the lower stackable tote 12' when the two totes 12, 12' are in a seated arrangement 82, i.e., a stowed configuration that may be used for storage or transport of plurality of the totes 12, 12' and the lids 14, 14'. The at least one flange support 80, 80' includes a pair of intersecting support panels oriented in a substantially transverse configuration. Each of the at least one flange supports 80, 80' may have a length that extends below the bottom surface of the each of the at least one latches 78, 78'.

In an eighteenth embodiment, and as shown in FIG. 9A, a length (L) of the at least one flange support 80 is sufficient to support the latch 78 in a raised position while in the seated arrangement 82. This raised position provides a clearance (CL) between adjacent latches 78, 78' of the upper stackable tote 12 and the lower stackable tote 12' which are in the seated arrangement 82. As illustrated in FIG. 9A, an example of the clearance (CL) would be between 0.10 inches and 0.25 inches, more particularly between 0.15 inches and 0.20 inches, and most particularly about 0.17 inches. However, one of ordinary skill in the art may also select other suitable clearances (CL), and in particular suitable clearances (CL) that permit a user to comfortably grip the latch 78 with the user's fingers where the latch 78 is stacked adjacent to the other latch 78', as desired.

Figure 10:
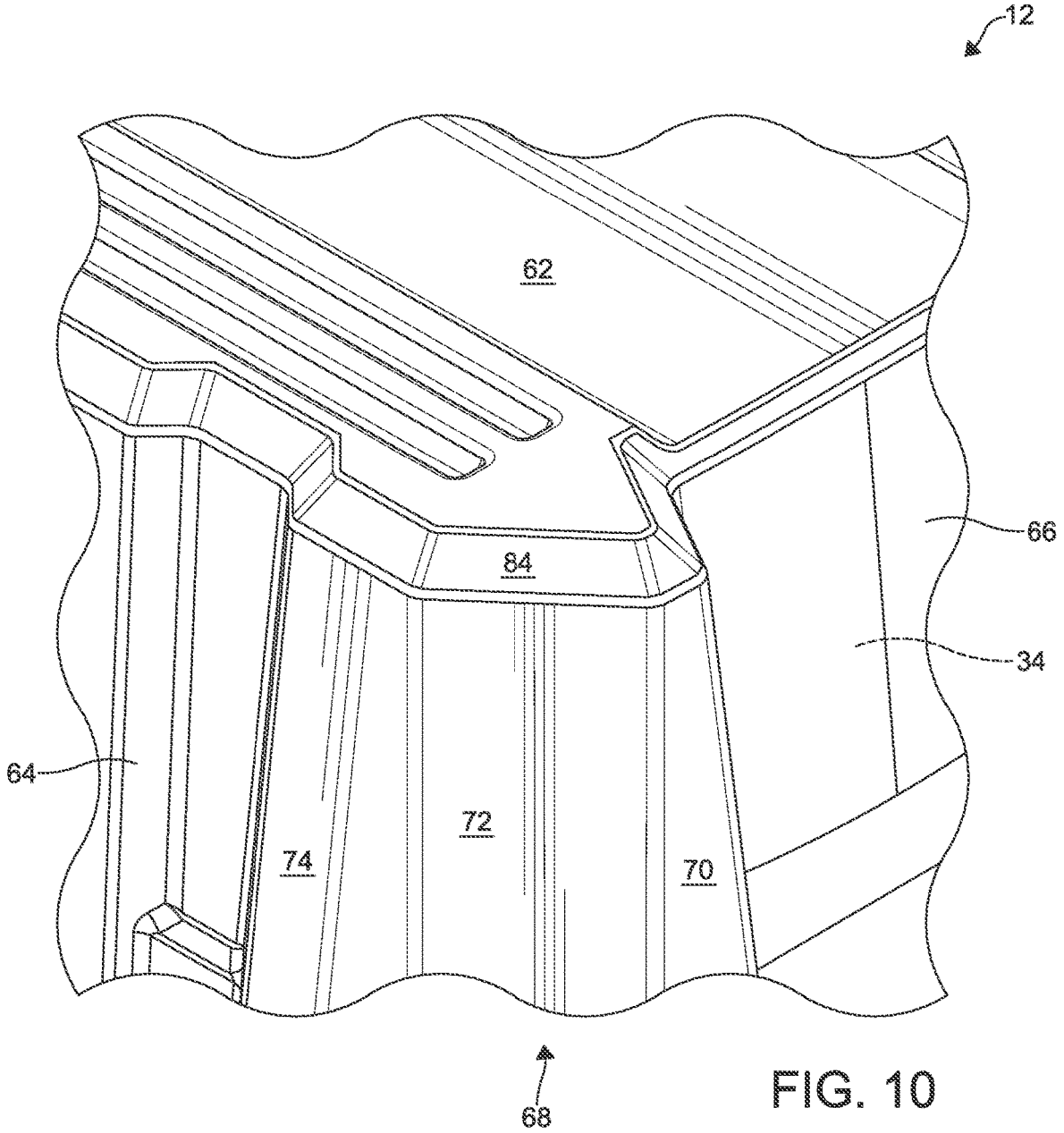
FIG. 10 is an enlarged fragmentary bottom perspective view of a front right exterior corner body of the upper tote of FIG. 1.

In a nineteenth embodiment, and as shown in FIG. 10, the upper stackable tote 12 has at least one upper beveled wall 84 interposed between and connected to the upper corner section 68 and the upper base wall 62. As described further hereinabove, and in association with the obtuse angle $\alpha$ of the at least one corner body 24*a*, 24*b*, 24*c*, 24*d* walls, the at least one upper beveled wall 84 is configured to facilitate an insertion of the upper base wall 62 into the lower lid 14' (see FIG. 1).

In a twentieth embodiment, as illustrated in FIGS. 1 and 7, the stackable tote 12 includes the hollow body 34 that has the base wall 62, the first sidewall 64, the second sidewall 66, and the corner section 68. Each of the first sidewall 64, the second sidewall 66, and the corner section 68 are connected to the base wall 62. The at least one corner section 68 is interposed between and connected to the first sidewall 64 and the second sidewall 66. The at least one corner section 68 includes the first exterior surface 70, the second exterior surface 72, and a third exterior surface 74.

In a most particular embodiment, and where the upper combination 10 and the lower combination 10' are stack as shown in FIG. 1, it should be appreciated that the first exterior surface 70 abuts the first outer side surface 28 of the respective corner body 24*a*, 24*b*, 24*c*, 24*d*, the second exterior surface 72 abuts the second outer side surface 30 of the respective corner body 24*a*, 24*b*, 24*c*, 24*d*, and the third exterior surface 74 abuts the third outer side surface 32 of the respective corner body 24*a*, 24*b*, 24*c*, 24*d*. The employment of these three areas of contact at each of the corner bodies 24*a*, 24*b*, 24*c*, 24*d* facilitates a more secure stacking and holding of the base wall 62 of the upper stackable tote 12 onto within the underlying lower lid 14'.

It should be understood that the storage tote 12 and lid 14 combination 10, 10' described herein is lightweight, stackable, and resistant to toppling when stacked several totes high. Furthermore, the aforementioned combination 10, 10' facilitates both a latching and a stacking of the storage totes 12 in operation, and thus has certain advantages relative to tote and lid combinations of the prior art.

While certain representative embodiments and details have been shown for purposes of illustrating the invention, it will be apparent to those skilled in the art that various changes may be made without departing from the scope of the disclosure, which is further described in the following appended claims.

What is claimed is:

1. A stackable tote configured for use with a lid, comprising:

a hollow body having a base wall, an upper flange, a first sidewall, and a second sidewall, each of the first sidewall and the second sidewall connected to each of the base wall and the upper flange, the upper flange having at least one flange support depending therefrom; and at least one latch rotatably attached to the upper flange and configured to securely hold the lid to the upper flange of the hollow body, the at least one latch having a bottom surface, a side surface, and a top surface;

wherein the at least one flange support has a length that extends below the bottom surface of the at least one latch;

wherein the at least one flange support includes a pair of intersecting support panels oriented in a substantially transverse configuration.

2. The stackable tote of claim 1, wherein the bottom surface of the at least one latch includes a channel.

3. The stackable tote of claim 2, wherein the channel has a protrusion, the protrusion extending downwardly toward the bottom surface of the at least one latch.

4. The stackable tote of claim 3, wherein a length of the protrusion is substantially the same as a length of the channel.

5. The stackable tote of claim 3, wherein the side surface of the at least one latch has an exterior surface marking configured to physically direct a user to the protrusion.

6. The stackable tote of claim 5, wherein the exterior surface marking includes a plurality of V-shaped markings.

7. The stackable tote of claim 3, wherein a length of the protrusion is less than a length of the channel.

8. The stackable tote of claim 1, wherein the top surface of the at least one latch is disposed at a height above the upper flange of the hollow body.

9. The stackable tote of claim 1, further comprising at least one beveled wall interposed between and connecting each of the first sidewall and the second sidewall to the base wall, the at least one beveled wall configured to facilitate a positioning of a plurality of totes in a stacked arrangement.

10. The stackable tote of claim 1, wherein the upper flange has a plurality of flange supports depending therefrom adjacent to the first side wall and a plurality of flange supports depending therefrom adjacent to the second side wall.

11. A stacked arrangement of totes, each tote configured for use with a lid, comprising:

a plurality of stackable totes, each of the stackable totes including:

a hollow body having a base wall, an upper flange, a first sidewall, and a second sidewall, each of the first sidewall and the second sidewall connected to each of the base wall and the upper flange, the upper flange having at least one flange support depending therefrom, and at least one latch rotatably attached to the upper flange and configured to securely hold the lid to the upper flange of the hollow body, the at least one latch having a bottom surface, a side surface, and a top surface, wherein the at least one flange support has a length that extends below the bottom surface of the at least one latch;

wherein the at least one flange support includes a pair of intersecting support panels oriented in a substantially transverse configuration; and wherein one stackable tote is positioned in a seated arrangement within the hollow body of another stackable tote.

12. The stacked arrangement of totes of claim 11, wherein the at least one latch has a bottom surface that includes a channel, wherein the channel is configured to provide an additional spacing between the latch of the one stackable tote and the latch of the another stackable tote in the seated arrangement.

13. The stacked arrangement of totes of claim 11, wherein the at least one flange support depending from the upper flange of the one stackable tote abuts the upper flange of the another stackable tote in the seated arrangement.

14. The stacked arrangement of totes of claim 13, wherein the at least one flange support of the one stackable tote further includes a length that extends below the latch of the one stackable tote, wherein the length of the at least one flange support of the one stackable tote is sufficient to support the latch of the one stackable tote in a raised position in the seated arrangement.

15. The stacked arrangement of totes of claim 14, wherein the raised position of the latch of the one stackable tote provides a clearance between the latch of the one stackable tote and the latch of the another stackable tote.

16. The stacked arrangement of totes of claim 15, wherein the clearance between the latch of the one stackable tote and the latch of the another stackable tote is configured to allow a user to insert one or more fingers within the clearance between the latch of the one stackable tote and the latch of the another stackable tote.

17. The stacked arrangement of totes of claim 15, wherein the clearance between the latch of the one stackable tote and the latch of the another stackable tote includes a clearance of between 0.10 inches and 0.25 inches.

18. The stacked arrangement of totes of claim 15, wherein the clearance between the latch of the one stackable tote and the latch of the another stackable tote includes a clearance of between 0.15 inches and 0.20 inches.

19. The stacked arrangement of totes of claim 15, wherein the clearance between the latch of the one stackable tote and the latch of the another stackable tote includes a clearance of about 0.17 inches.

20. A stackable tote configured for use with a lid, comprising:

a hollow body having a base wall, an upper flange, a first sidewall, and a second sidewall, each of the first sidewall and the second sidewall are connected to each of the base wall and the upper flange, the hollow body further including at least one beveled wall interposed between and connecting each of the first sidewall and the second sidewall to the base wall, the at least one beveled wall configured to facilitate a positioning of a plurality of totes in a stacked arrangement, and the upper flange having at least one flange support depending therefrom, each of the at least one flange supports including a pair of intersecting support panels oriented in a substantially transverse configuration; and at least one latch rotatably attached to the upper flange and configured to securely hold the lid to the upper flange of the hollow body, the at least one latch having a bottom surface, a side surface, and a top surface, the at least one latch including a channel on the bottom surface thereof, the at least one flange support having a length that extends below the at least one latch, the channel having a protrusion extending downwardly toward the bottom surface of the at least one latch, a length of the protrusion being substantially the same as a length of the channel, and the at least one latch including an exterior surface marking configured to physically direct a user to the protrusion.

* * * * *